US007109929B1

(12) United States Patent
Ryken, Jr. et al.

(10) Patent No.: US 7,109,929 B1
(45) Date of Patent: Sep. 19, 2006

(54) TM MICROSTRIP ANTENNA

(75) Inventors: Marvin L. Ryken, Jr., Oxnard, CA (US); Albert F. Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/145,234

(22) Filed: Jun. 1, 2005

Related U.S. Application Data

(63) Continuation-in-part of application No. 10/817,412, filed on Mar. 31, 2004, now Pat. No. 7,009,564, which is a continuation-in-part of application No. 10/664,614, filed on Sep. 19, 2003, now Pat. No. 6,856,290.

(51) Int. Cl.
*H01Q 1/38* (2006.01)

(52) U.S. Cl. ..... 343/700 MS; 343/705; 343/853

(58) Field of Classification Search ..... 343/700 MS, 343/846, 853, 705
See application file for complete search history.

(56) References Cited

U.S. PATENT DOCUMENTS

| | | | | |
|---|---|---|---|---|
| 4,914,445 | A * | 4/1990 | Shoemaker | 343/700 MS |
| 5,216,430 | A * | 6/1993 | Rahm et al. | 343/700 MS |
| 6,466,172 | B1 * | 10/2002 | Ryken et al. | 343/700 MS |
| 6,549,168 | B1 * | 4/2003 | Ryken et al. | 343/700 MS |
| 6,856,290 | B1 * | 2/2005 | Ryken et al. | 343/700 MS |
| 6,943,737 | B1 * | 9/2005 | Ryken et al. | 343/700 MS |
| 7,009,564 | B1 * | 3/2006 | Ryken et al. | 343/700 MS |

* cited by examiner

*Primary Examiner*—Hoang V. Nguyen
(74) *Attorney, Agent, or Firm*—David S. Kalmbaugh

(57) ABSTRACT

A TM microstrip antenna designed to transmit telemetry data for use by a fourteen inch diameter projectile. The microstrip antenna is configured to wrap around the projectile's body without interfering with the aerodynamic design of the projectile. The TM microstrip antenna operates at the 2200 to 2300 MHz TM frequency band. Eight microstrip antenna elements equally spaced around the projectile provide for linear polarization and a quasi-omni directional radiation pattern.

19 Claims, 3 Drawing Sheets

TM MICROSTRIP ANTENNA

This application is a continuation-in-part of U.S. patent application Ser. No. 10/817,412, filed Mar. 31, 2004, now U.S. Pat. No. 7,009,564, which is a continuation-in-part of U.S. patent application Ser. No. 10/664,614, filed Sep. 19, 2003, U.S. Pat. No. 6,856,290.

BACKGROUND OF THE INVENTION

1. Field of the Invention

The present invention relates generally to a microstrip antenna for use on a weapons system to transmit telemetry data. More specifically, the present invention relates to a TM cylindrical shaped microstrip antenna array having a GPS band stop filter which transmits telemetry data and which is adapted for use on a 14-inch diameter weapons system such as a missile.

2. Description of the Prior Art

A microstrip antenna operates by resonating at a frequency. The conventional design uses printed circuit techniques to put a printed copper patch on the top of a layer of dielectric with a ground plane on the bottom of the dielectric layer. The frequency that the microstrip antenna operates at is approximately a half-wavelength in the microstrip medium of dielectric below the patch and air above the patch.

There is currently a need to provide a quasi omni-directional radiation pattern from a conformal wrap-around microstrip antenna with a 14-inch maximum diameter and 5-inch maximum length. The antenna is to be used on a weapons system or projectile such as a missile. The required frequency of operation for the antenna is 2200 to 2300 MHz telemetry (TM) frequency band. The antenna must also provide for additional isolation of RF noise from the TM transmitter on the 14-inch diameter missile at the GPS L1 frequency band which is 1565 to 1585 MHz.

SUMMARY OF THE INVENTION

The present invention overcomes some of the disadvantages of the past including those mentioned above in that it comprises a highly effective and efficient microstrip antenna designed to transmit telemetry data for use at a receiving station. The microstrip antenna comprising the present invention is configured to wrap around the projectile's body without interfering with the aerodynamic design of the projectile.

The TM microstrip antenna is designed to transmit telemetry data and is adapted for use on a fourteen inch diameter projectile. The TM microstrip antenna operates at the 2200 to 2300 MHz TM frequency band. Eight microstrip antenna elements equally spaced around the projectile provide for linear polarization and a quasi-omni directional radiation pattern.

The TM microstrip antenna includes a feed network which consist of equal amplitude and phase power dividers and a GPS band stop filter at the GPS L1 frequency band so that noise from the TM transmitter will be reduced to an acceptable noise level of approximately 50 decibels.

DETAILED DESCRIPTION OF THE PREFERRED EMBODIMENT

Figure 1:
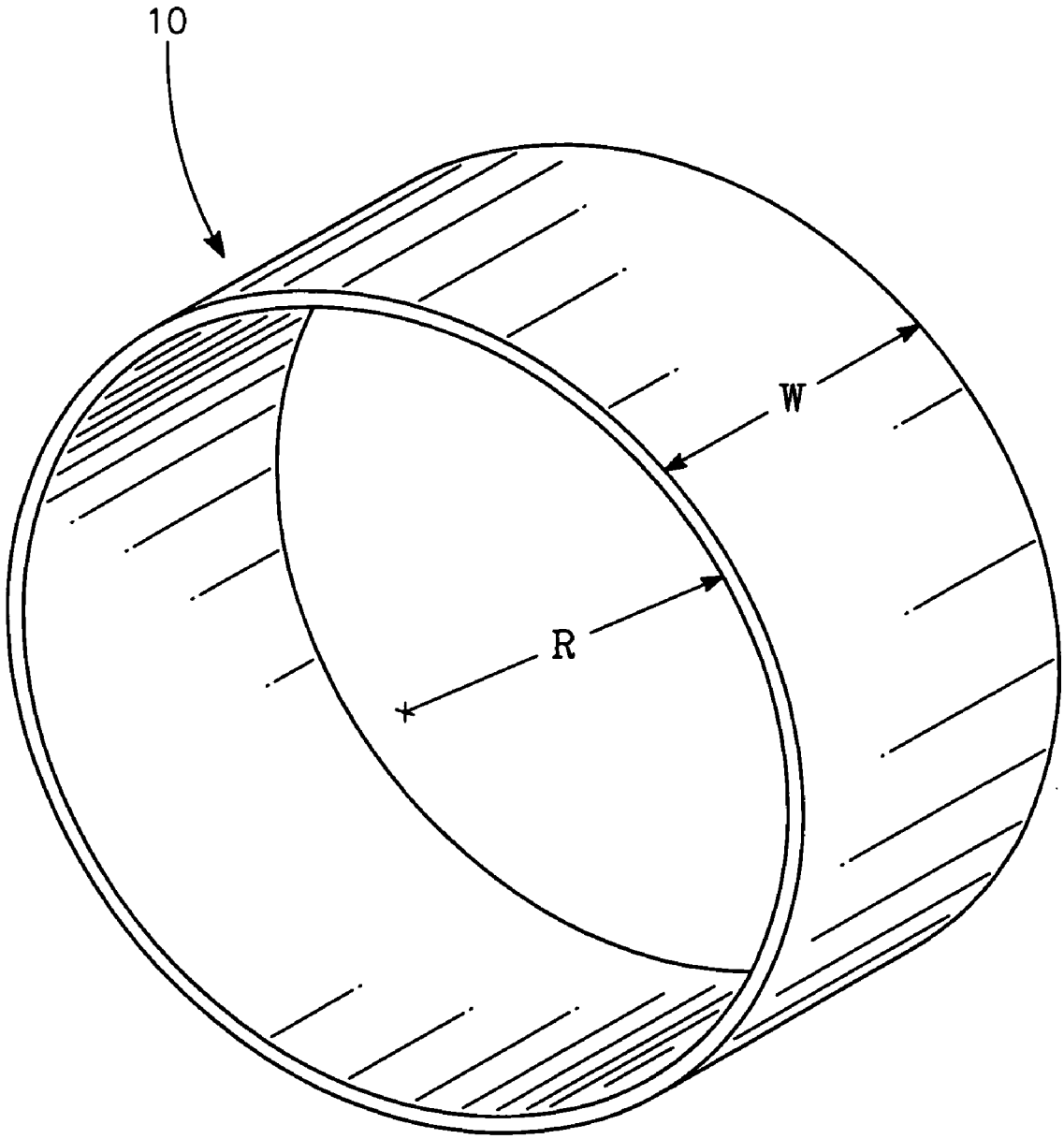
FIG. 1 is a perspective view of the TM microstrip antenna comprising the present invention.
Figure 2:
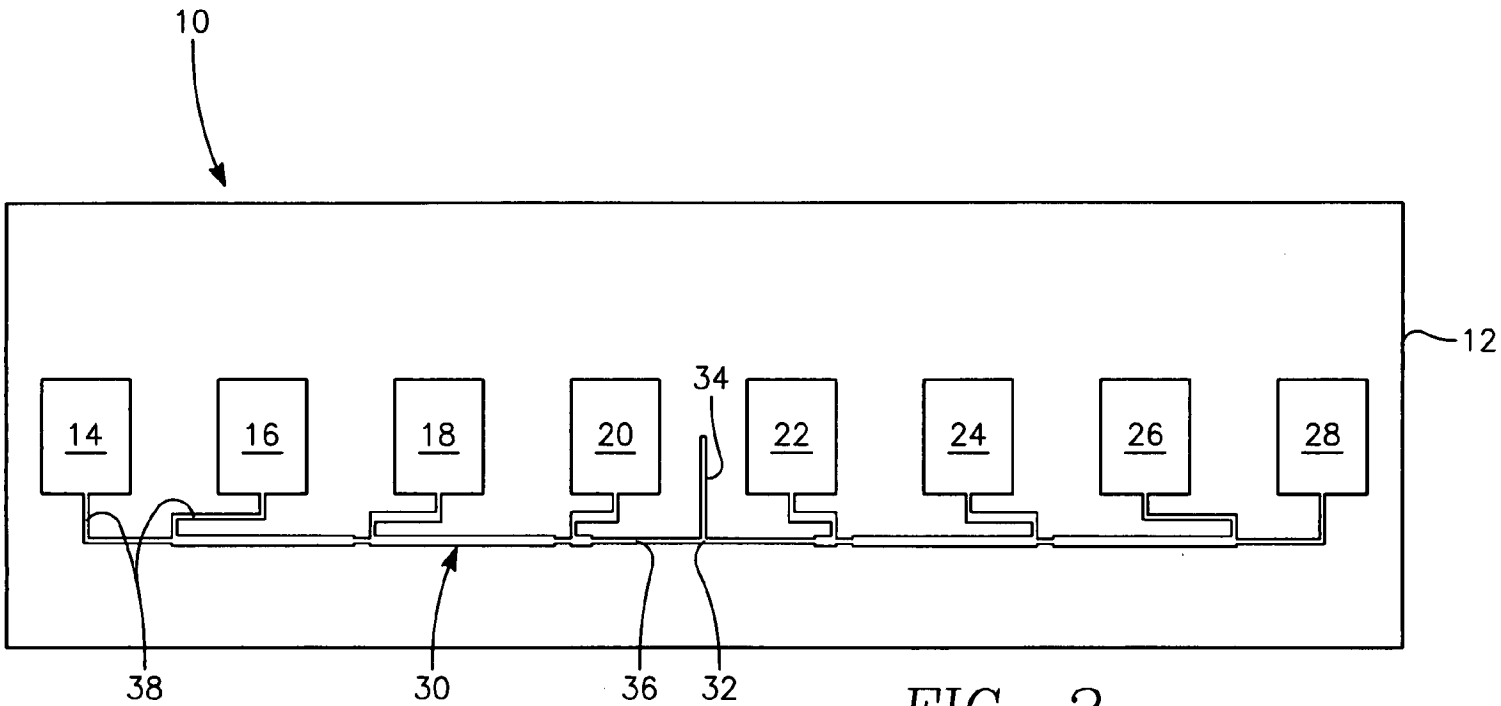
FIG. 2 is a view illustrating the top layer of the circuit printed circuit board for the TM microstrip antenna of FIG. 1.

Referring to FIGS. 1 and 2, there is shown a TM microstrip antenna 10 which is a wrap around conformal antenna designed for a small projectile having a maximum diameter of fourteen inches which equates to a maximum radius R of seven inches. The actual radius of the antenna 10 is 6.969 inches. The maximum width W for antenna 10 is five inches. Antenna 10 operates at the TM Band centered at 2.25 GHz. The frequency of operation is 2200 to 2300 MHz telemetry (TM) frequency band and there is a band stop filter requirement at the GPS frequency range of 1565 to 1585 MHz. Antenna 10 provides for quasi-omni directional radiation pattern coverage.

Referring again to FIGS. 1 and 2, the top layer of the circuit printed circuit board 12 for microstrip antenna 10 includes eight half-wavelength antenna elements 14, 16, 18, 20, 22, 24, 26 and 28. Equally dividing the circumference of GPS microstrip antenna 10 into eight parts in the manner illustrated in FIG. 2 and placing a half-wavelength microstrip antenna element 14, 16, 18, 20, 22, 24, 26 and 28 in each part provides the required quasi-omni direction radiation pattern. The bottom layer of circuit printed circuit board 12 comprises dielectric material. The antenna elements 14, 16, 18, 20, 22, 24, 26 and 28 have a rectangular shape and are fabricated from etched copper.

The top layer of the circuit printed circuit 12 board includes a feed network 30 and a signal input 32 which receives telemetry data from the weapon's on board telemetry system. The signal input 32 is located at the center of the top layer of circuit printed circuit board 12 as shown in FIG. 2. One end of a single quarter wavelength open-circuited stub 34 tuned at the GPS frequency band is connected to signal input 32. The open-circuited stub 34 forms a GPS band stop filter that substantially reduces noise from the TM signal at the GPS frequency band, which is 1565 MHz to 1585 MHz. An acceptable noise level reduction may be for example 50 decibels.

The open circuited stub 34 is also connected to the feed network 30 for TM microstrip antenna 10. The feed network 30 drives each of the microstrip antenna elements 14, 16, 18, 20, 22, 24, 26 and 28 of antenna 10 with equal amplitude and equal phase. The feed network 30 includes a main transmission line 36 and eight branch transmission lines 38.

The two end antenna 14 and 28 elements located at each end of the circuit printed circuit board 12 are of an equal phase because the lengths of the transmission line to the antenna elements 14 and 28 form the signal input 32 are identical. The remaining antenna elements 16, 18, 20, 22, 24 and 26 are also equal phase but may differ by a multiple of 360 degrees. The configuration of feed network 30 insures that the feed network 30 operates as an equal amplitude, equal phase power divider providing for equal distribution of RF signals with respect to the eight antenna elements 12, 14, 16, 18, 20, 22, 24, and 26 in both amplitude and phase.

The feed network 30 matches a 50 ohm input impedance to the signal input 32. The polarization of TM microstrip antenna 10 is linear polarization.

Figure 3:
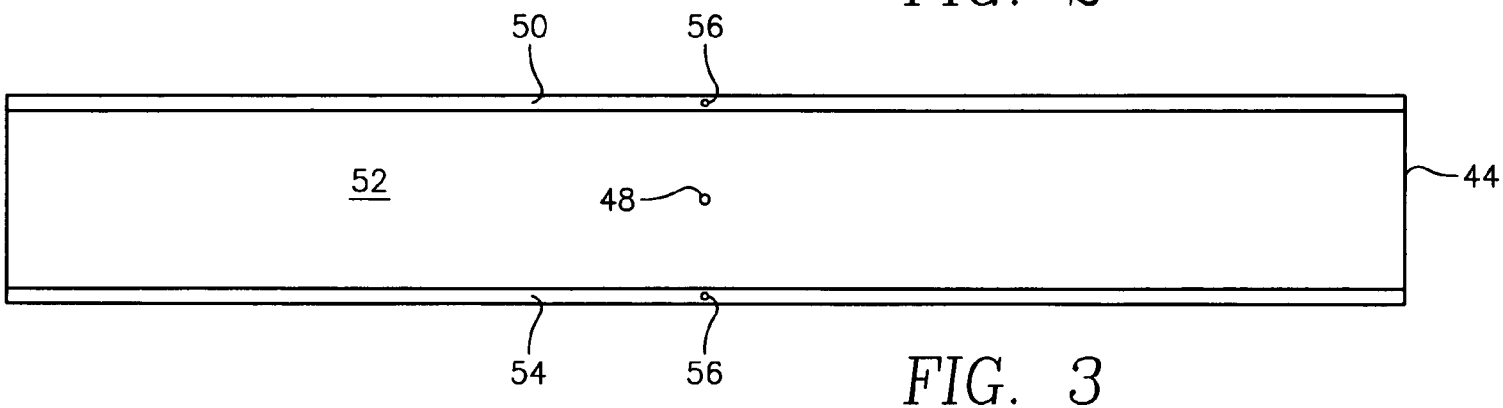
FIG. 3 is a view illustrating the bottom layer of the ground printed circuit board for the GPS antenna of FIG. 1.
Figure 5:
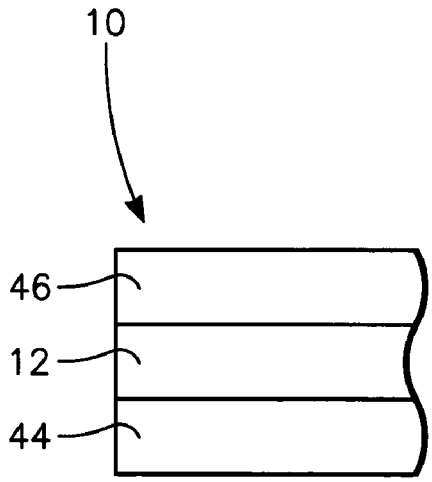
FIG. 5 is a view illustrating the three dielectric layers stacked on top of one another which form the GPS microstrip antenna comprising the present invention.

Referring to FIGS. 1, 3 and 5, TM microstrip antenna 10 comprises three Printed Circuit Board layers 12, 44 and 46 stacked on top of one another in the manner illustrated in FIG. 5. The outside layer 46 is a protective layer having a thickness of 0.062 inches and is fabricated from Rogers Corporation RT/5870. The middle Printed Circuit Board layer is Circuit Printed Circuit Board 12 and the inside layer is the Ground Printed Circuit Board 44. Both the Circuit and Ground Printed Circuit Boards are made from Rogers Corporation's Duriod RT/6002 with a 0.060-inch thickness clad with one-ounce copper. The material used for the Circuit and Ground Printed Circuit Boards were selected because of their extremely stable properties with respect to temperature. Two layers are required because a thickness in excess of 0.060-inch would result in cracking when the Printed Circuit Boards 12 and 44 are bent into the configuration required by antenna 10. As shown in FIG. 5, the bottom layer of the Ground Printed Circuit Board 44 is solid copper with a clearance hole 48 for the signal input 32. The top layer of the Ground Printed Circuit Board 44 and bottom layer of the Circuit Printed Circuit Board 12 have no copper resulting in a dielectric surface. The Printed Circuit Boards 12, 44 and 46 are gold plated to protect the boards from environmental conditions and a high bonding temperature.

An SMA female chassis mount connector is installed on the inside of the antenna 10 at the input location 32 to connect antenna 10 to the weapons system on board telemetry system.

Figure 4:
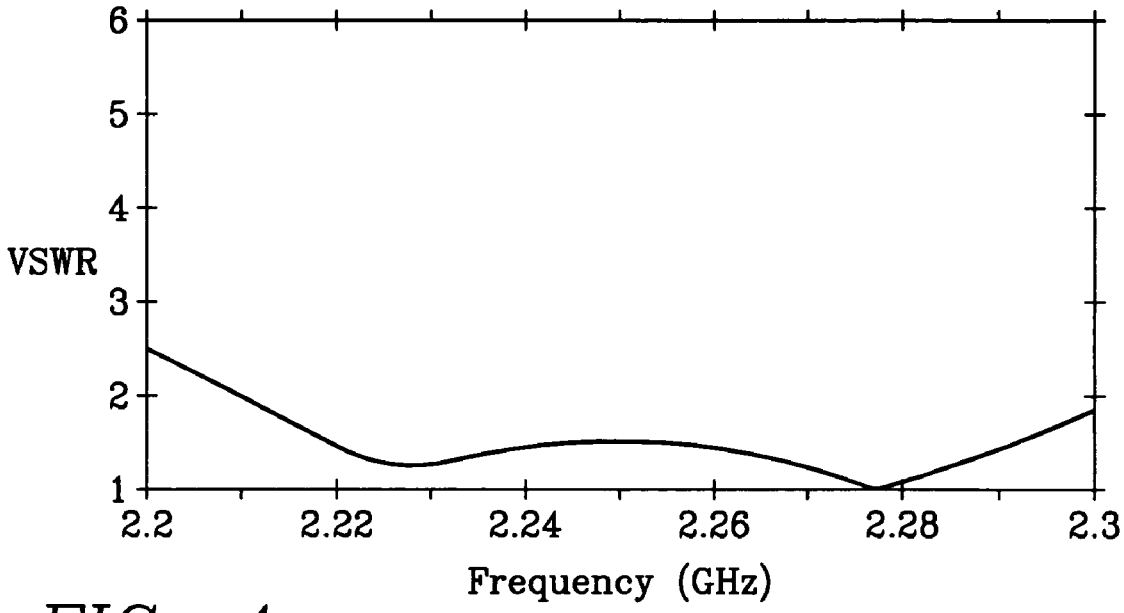
FIG. 4 is a plot illustrating a voltage standing wave ratio plot for the GPS microstrip antenna of FIG. 1.

Referring to FIG. 4, the Voltage Standing Wave Ratio (VSWR) for antenna 10 was measured and a typical response is shown in FIG. 4. It should be noted that the VSWR is less than 2:1 over most of the 2200 to 2300 MHz TM frequency range.

Referring to FIGS. 3 and 5, the ground printed circuit board 44 of TM microstrip antenna 10, has an upper portion boarder 50 (depicted in FIG. 3) above the copper plated middle portion 52, and a lower portion or border 54. The boarders 50 and 54 of ground printed circuit board 44, which each have a width of 0.50 of an inch, are machined off during the fabrication process for TM microstrip antenna 10. Printed Circuit Boards 12 and 44 also have 0.50 inch upper and lower portions or boarders which are machined off during the fabrication process for TM microstrip antenna 10. Alignment holes 56 are centrally located in the boarders 50 and 54 of board 44 as well as boards 12 and 46. The alignment holes in each of the boards 12, 14 and 46 are used to align the Printed Circuit Boards 12, 44 and 46 during the high temperature bonding process which bonds the boards 12, 44 and 46 together. The alignment holes 56 have a ¼" diameter.

When TM microstrip antenna 10 is fully assembled only the copper plated middle portion 48 of circuit board 52 remains. The middle portion of the circuit printed circuit board 12 which includes the antenna elements and feed network, as shown in FIG. 2, is the only portion of board 12 which remains when the fabrication of the TM microstrip antenna 10 is complete. The 0.5 inch boarders of each printed circuit board 12, 14 and 44 are machined off after the boards are bonded together.

Mounting holes are placed as required along both edges of the TM microstrip antenna 10 within 0.375 inch from each edge of the antenna 10.

From the foregoing, it is readily apparent that the present invention comprises a new, unique, and exceedingly useful TM microstrip antenna adapted for use on 14-inch diameter projectiles, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A 14-inch diameter TM microstrip antenna comprising:

(a) a first dielectric layer;

(b) eight rectangular shaped antenna elements mounted on an upper surface of said first dielectric layer, said antenna elements being equally spaced apart, aligned with one another and fabricated from copper, said eight antenna elements being adapted to transmit RF carrier signals containing telemetry data at a frequency of approximately 2.25 GHz;

(c) an antenna feed network mounted an upper surface of said first dielectric layer, said antenna feed network having a main transmission line connected to a centrally located signal input for said 14-inch diameter TM microstrip antenna, said antenna feed network having eight branch transmission lines, each one of said eight branch transmission lines having one end connected to said main transmission line and the other end connected to one antenna element of said eight antenna elements, said antenna feed network being configured to drive said eight antenna elements with equal phase and equal amplitude signals resulting in a linear polarization and an omni-directional radiation pattern being generated by said eight antenna elements of said 14-inch diameter TM microstrip antenna; and (d) a GPS band stop filter connected to the signal input for said 14-inch TM microstrip antenna, said GPS band stop filter being tuned at a GPS frequency band so that said GPS band stop filter substantially reduces noise from the RF carrier signals at a GPS frequency band of 1565 MHz to 1585 MHz;

(e) a second dielectric layer positioned below said first dielectric layer in alignment with said first dielectric layer, said second dielectric layer having a solid copper ground plane affixed to a bottom surface of said second dielectric layer; and (f) a third dielectric layer positioned above said first dielectric layer in alignment with said first dielectric layer wherein said third dielectric layer functions as a dielectric protective layer for said 14-inch diameter TM microstrip antenna.

2. The 14-inch diameter TM microstrip antenna of claim 1 wherein the signal input for said 14-inch diameter TM microstrip antenna matches a 50 ohm input impedance to the signal input for said 14-inch diameter TM microstrip antenna.

3. The 14-inch diameter TM microstrip antenna of claim 1 wherein said first dielectric layer, said second dielectric layer and said third dielectric layer each have a pair of 0.5 inch dielectric borders running along the length of said fourteen inch diameter GPS microstrip antenna, said pair of borders for said first dielectric layer, said second dielectric layer and said third dielectric layer being removed after a high temperature bonding process used to assemble said 14-inch diameter TM microstrip antenna is completed.

4. The 14-inch diameter TM microstrip antenna of claim 1 wherein said first dielectric layer, said second dielectric layer and said third dielectric layer are gold plated to protect said first dielectric layer, said second dielectric layer and said third dielectric layer from environmental conditions and high bonding temperatures.

5. The 14-inch diameter TM microstrip antenna of claim 1 wherein said band stop filter comprises a quarter wavelength open-circuited stub mounted on the upper surface of said first dielectric layer and fabricated from etched copper.

6. The 14-inch diameter TM microstrip antenna of claim 1 wherein said 14-inch diameter TM microstrip antenna provides for a voltage standing wave ratio of less than 2:1 over a TM frequency range of 2200 MHz to 2300 MHz.

7. The 14-inch diameter TM microstrip antenna of claim 1 wherein said first dielectric layer comprises a circuit printed circuit board and said second dielectric layer comprises a ground printed circuit board, said circuit printed circuit board and said ground printed circuit board each having a width of 5.0 inches and a radius of approximately 7.0 inches.

8. The 14-inch diameter TM microstrip antenna of claim 1 wherein said third dielectric layer has a 0.062-inch thickness, a width of 5.0 inches and a radius of approximately 7.0 inches.

9. The 14-inch diameter TM microstrip antenna of claim 1 wherein said first dielectric layer and said second dielectric layer each have a 0.060-inch thickness clad with one-ounce copper to prevent cracking of said first dielectric layer and said second dielectric layer when said first dielectric layer and said second dielectric layer are mounted on a projectile.

10. A 14-inch diameter TM microstrip antenna comprising:

(a) a first dielectric layer;

(b) eight rectangular shaped antenna elements mounted on an upper surface of said first dielectric layer, said antenna elements being equally spaced apart, aligned with one another and fabricated from copper, said eight antenna elements being adapted to transmit RF carrier signals containing telemetry data at a frequency of approximately 2.25 GHz;

(c) an antenna feed network mounted an upper surface of said first dielectric layer, said antenna feed network having a main transmission line connected to a centrally located signal input for said 14-inch diameter TM microstrip antenna, said antenna feed network having eight branch transmission lines, each one of said eight branch transmission lines having one end connected to said main transmission line and the other end connected to one antenna element of said eight antenna elements, said antenna feed network being configured to drive said eight antenna elements with equal phase and equal amplitude signals resulting in a linear polarization and an omni-directional radiation pattern being generated by said eight antenna elements of said 14-inch diameter TM microstrip antenna; and (d) a GPS band stop filter connected to the signal input for said 14-inch TM microstrip antenna, said GPS band stop filter being tuned at a GPS frequency band so that said GPS band stop filter substantially reduces noise from the RF carrier signals at a GPS frequency band of 1565 MHz to 1585 MHz; and (e) a second dielectric layer positioned below said first dielectric layer in alignment with said first dielectric layer, said second dielectric layer having a solid copper ground plane affixed to a bottom surface of said second dielectric layer, wherein said first dielectric layer and said second dielectric layer each have a 0.060-inch thickness clad with one-ounce copper to prevent cracking of said first dielectric layer and said second dielectric layer when said first dielectric layer and said second dielectric layer are mounted on a projectile; and (f) a third dielectric layer positioned above said first dielectric layer in alignment with said first dielectric layer wherein said third dielectric layer functions as a dielectric protective layer for said 14-inch diameter TM microstrip antenna.

11. The 14-inch diameter TM microstrip antenna of claim 10 wherein the signal input for said 14-inch diameter TM microstrip antenna matches a 50 ohm input impedance to the signal input for said 14-inch diameter TM microstrip antenna.

12. The 14-inch diameter TM microstrip antenna of claim 10 wherein said first dielectric layer, said second dielectric layer and said third dielectric layer each have a pair of 0.5 inch dielectric borders running along the length of said fourteen inch diameter GPS microstrip antenna, said pair of borders for said first dielectric layer, said second dielectric layer and said third dielectric layer being removed after a high temperature bonding process used to assemble said 14-inch diameter TM microstrip antenna is completed.

13. The 14-inch diameter TM microstrip antenna of claim 10 wherein said first dielectric layer, said second dielectric layer and said third dielectric layer are gold plated to protect said first dielectric layer, said second dielectric layer and said third dielectric layer from environmental conditions and high bonding temperatures.

14. The 14-inch diameter TM microstrip antenna of claim 10 wherein said band stop filter comprises a quarter wavelength open-circuited stub mounted on the upper surface of said first dielectric layer and fabricated from etched copper.

15. The 14-inch diameter TM microstrip antenna of claim 10 wherein said 14-inch diameter TM microstrip antenna provides for a voltage standing wave ratio of less than 2:1 over a TM frequency range of 2200 MHz to 2300 MHz.

16. The 14-inch diameter TM microstrip antenna of claim 10 wherein said first dielectric layer comprises a circuit printed circuit board, said second dielectric layer comprises a ground printed circuit board and said third dielectric layer comprises a protective board, said circuit printed circuit board, said ground printed circuit board and said protective board each having a width of 5.0 inches and a radius of approximately 7.0 inches.

17. The 14-inch diameter TM microstrip antenna of claim 16 wherein said third dielectric layer has a 0.062-inch thickness.

18. A 14-inch diameter TM microstrip antenna comprising:

(a) a first dielectric layer;

(b) eight rectangular shaped antenna elements mounted on an upper surface of said first dielectric layer, said antenna elements being equally spaced apart, aligned with one another and fabricated from copper, said eight antenna elements being adapted to transmit RF carrier signals containing telemetry data at a frequency of approximately 2.25 GHz;

(c) an antenna feed network mounted an upper surface of said first dielectric layer, said antenna feed network having a main transmission line connected to a centrally located signal input for said 14-inch diameter TM microstrip antenna, said antenna feed network having eight branch transmission lines, each one of said eight branch transmission lines having one end connected to said main transmission line and the other end connected to one antenna element of said eight antenna elements, said antenna feed network being configured to drive said eight antenna elements with equal phase and equal amplitude signals resulting in a linear polarization and an omni-directional radiation pattern being generated by said eight antenna elements of said 14-inch diameter TM microstrip antenna; and (d) a GPS band stop filter connected to the signal input for said 14-inch TM microstrip antenna, said GPS band stop filter being tuned at a GPS frequency band so that said GPS band stop filter substantially reduces noise from the RF carrier signals at a GPS frequency band of 1565 MHz to 1585 MHz wherein said band stop filter comprises a quarter wavelength open-circuited stub mounted on the upper surface of said first dielectric layer and fabricated from etched copper;

(e) a second dielectric layer positioned below said first dielectric layer in alignment with said first dielectric layer, said second dielectric layer having a solid copper ground plane affixed to a bottom surface of said second dielectric layer, wherein said first dielectric layer and said second dielectric layer each have a 0.060-inch thickness clad with one-ounce copper to prevent cracking of said first dielectric layer and said second dielectric layer when said first dielectric layer and said second dielectric layer are mounted on a projectile; and (f) a third dielectric layer positioned above said first dielectric layer in alignment with said first dielectric layer wherein said third dielectric layer functions as a dielectric protective layer for said 14-inch diameter TM microstrip antenna, said third dielectric layer having a 0.062-inch thickness; and (g) said first dielectric layer, said second dielectric layer and said third dielectric layer being gold plated to protect said first dielectric layer, said second dielectric layer and said third dielectric layer from environmental conditions and high bonding temperatures, said first dielectric layer, said second dielectric layer and said third dielectric layer each having a width of 5.0 inches and a radius of approximately 7.0 inches; and (h) said 14-inch diameter TM microstrip antenna providing for a voltage standing wave ratio of less than 2:1 over a TM frequency range of 2200 MHz to 2300 MHz.

19. The 14-inch diameter TM microstrip antenna of claim 18 wherein the signal input for said 14-inch diameter TM microstrip antenna matches a 50 ohm input impedance to the signal input for said 14-inch diameter TM microstrip antenna.

* * * * *